US005207175A

United States Patent [19]

Andonian

[11] Patent Number: 5,207,175

[45] Date of Patent: May 4, 1993

[54] MARKER POST

[76] Inventor: Garbis Andonian, 138 Grant St., Lexington, Mass. 02173

[21] Appl. No.: 852,672

[22] Filed: Mar. 17, 1992

[51] Int. Cl.[5] ..... E01F 9/00; G09F 7/22

[52] U.S. Cl. ..... 116/209; 52/103; 116/63 R; 248/156; 404/10

[58] Field of Search ..... 116/209, 63 R; 40/645; 404/10; 248/156

[56] References Cited

U.S. PATENT DOCUMENTS

| | | | |
|---|---|---|---|
| 2,949,324 | 8/1960 | Birge et al. | 404/10 X |
| 2,969,484 | 1/1961 | Suckow | 404/10 X |
| 3,279,133 | 10/1966 | DeKorte | 404/10 X |
| 3,371,647 | 3/1968 | Shopbell . | |
| 4,106,879 | 8/1978 | Diedershagen et al. | 404/10 X |
| 4,161,723 | 7/1979 | DeVittori | 116/209 X |
| 4,373,464 | 2/1983 | Blau | 116/63 R |
| 4,862,823 | 9/1989 | Hughes . | |

*Primary Examiner*—Daniel M. Yasich

[57] ABSTRACT

A marker post and the like comprises a base to be placed on or in the ground. A threaded hole or other fastening mechanism is located at the top of the base. A post is attached to the base by a spring. At the other end of the spring is a screw or other fastening mechanism which will operate with the fastening mechanism at the top of the base. When impacted by an external force, the marker post flexes.

11 Claims, 2 Drawing Sheets

MARKER POST

BACKGROUND OF THE INVENTION

1. Field of the Invention

The present invention relates in general to marker posts and more particularly concerns a marker post which will flex on impact and return to its previous upright position.

2. Description of Related Art

Marker posts have many uses, among them are marking paths, driveways, roads and holding up road signs. There are basically two types of marker posts, solid and semi-flexible. The solid marker post, upon impact, will either break in two, move completely or remain as it was before the impact. In all these situations extreme damage can occur to the marker post, the ground around the marker post and in particular, the impacting object.

The semi-flexible marker post is available in two versions, one will bend and not return to its previous position and the other will bend and return to its upright position.

The first version will bend and have to be manually straightened for the marker post to serve any purpose. This type is usually made from a soft aluminum. The second type of semiflexible marker post will flex and return to its upright position as long as it is impacted in the direction it is designed to flex. This version is described and covered in U.S. Pat. No. 4,862,823 entitled "Bendable Marker and Method of Marking". If the marker is hit in the direction that it is not designed to flex it is like a solid marker post. Another limitation with this type of marker post is that its flexing ability is gained through a flexible elastomic element or more simply a piece of plastic. The flexible plastic in this type of marker post may lose its strength or crack over time thereby not allowing it to return completely upright after impact.

A totally different type of marker post is the type covered by U.S. Pat. No. 3,371,647 entitled "Athletic Field Marker". The marker post covered by this patent is made of foam. This marker post is useful from the point of view of not causing damage to the impacting object but it lacks rigidity. The foam is soft and weak and can only be a certain length without requiring structural modifications to hold the marker up.

Another difficulty with most currently available markers are that they are of one piece construction which makes them difficult to install if they are of substantial height.

SUMMARY OF THE INVENTION

It is an important object of this invention to provide an improved marker post to avoid the limitations and problems with the marker posts currently available.

Another object of the invention is to provide a marker post which can be impacted without damage to the marker post or the object impacting it.

Another object of the invention is to provide a method for removing just the above-ground section of the post while leaving the marker post base in the ground should it be desired.

Another object of the invention is to provide a method for easily installing marker posts.

These and other objects of the invention are provided by a marker post that includes a base having a fastening mechanism. The upper section of the marker post is secured to the base through a fastening mechanism . The fastening mechanism is attached to a spring which is attached to a marker post pipe.

DESCRIPTION OF THE PREFERRED EMBODIMENT

Figure 1:
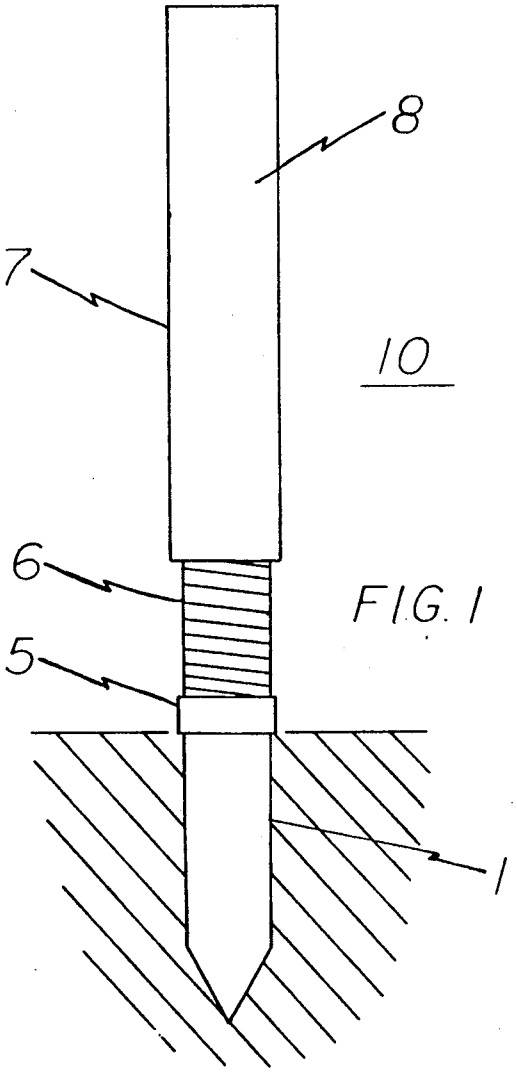
FIG. 1 illustrates the marker post installed in the ground in the upright position.

Referring to FIG. 1, a marker post 10 embodying the invention comprises a base 1, a stud 5, a spring 6 and a pipe 7. The base 1 is tapered or pointed at one end. The pipe 7 is pressed over one end of the spring 6. The stud 5 is pressed into the other end of the spring 6. The stud 5 is pressed into the other end of the spring 6. The stud 5 is secured to the other end of the base 1.

Figure 2:
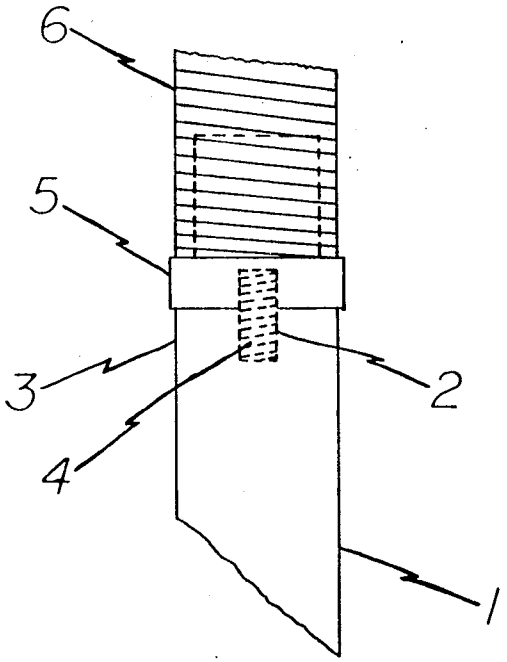
FIG. 2 illustrates the internal parts of the base and the upper section of the marker post and there connection.

Referring to FIG. 2, it can be seen specifically how the upper section of the marker post 8 is attached to the base 1. Base 1 includes a top portion 3 into which is drilled or inserted a threaded insert 2 for receiving a threaded portion 4 of the stud 5. Note that the threaded portion 4 may be a part of base 1 and the insert 2 may be a part of stud 5.

Figure 3:
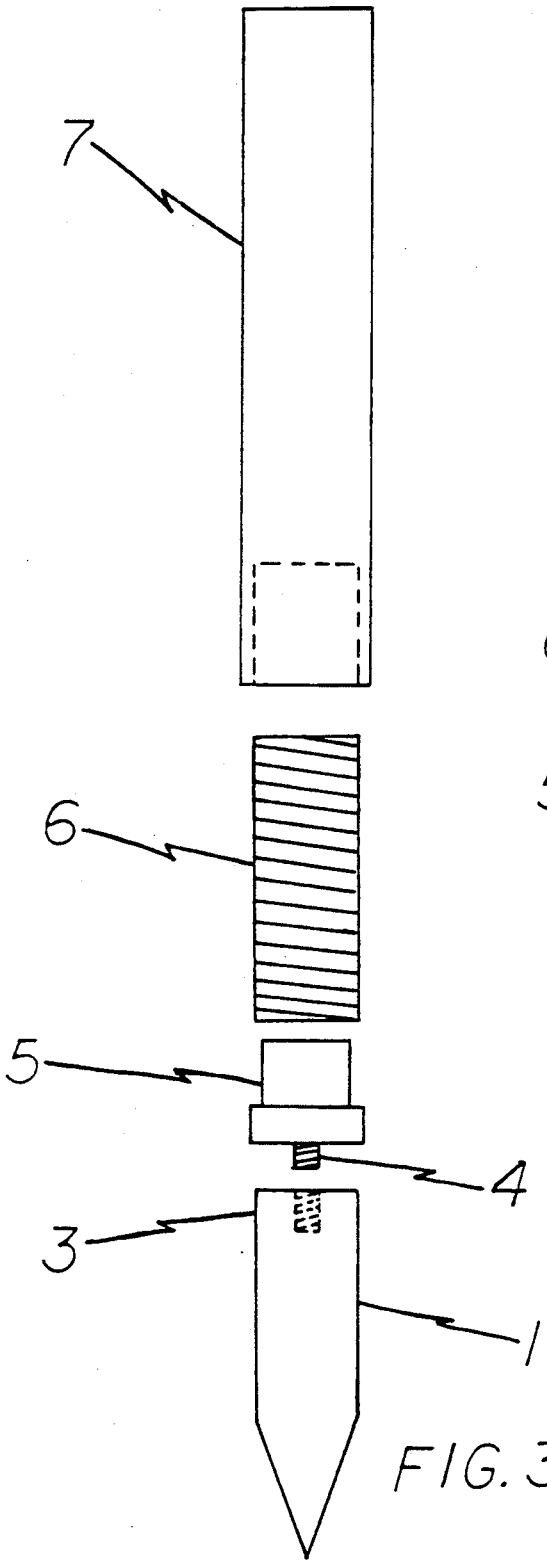
FIG. 3 illustrates all the marker post parts and how they are interrelated.

Referring to FIGS. 2 and 3 it can be seen that the upper section of the marker post 8 is made up of the pipe 7, the spring 6, the stud 5 and the stud screw 4. The upper section of the marker post 8 is attached to the base 1 by the threaded portion 4 which is threaded into the threaded insert 2 located at the top portion 3.

FIG. 3 illustrates the relationship of all the parts to each other and how they are connected. The upper section of the marker post 8, FIG. 1 is assembled by press fitting the spring 6 to the stud 5. The threaded portion 4 is already attached to the stud 5 before the spring 6 is press fit into the studs. The spring 6 is now press fit into the pipe 7. The upper section of the marker post 8 is now complete. The base 1 is coupled to the upper section 8 to complete the assembly of the marker 10.

The marker 10 is installed by first, unthreading the base 1 from the upper section of the marker post 8 and pushing or hammering the base 1 into the ground with the pointed end down and the top portion 3 up. When the base 1 is in the ground the top portion 3 and the insert 2 are visible. The upper section of the marker post 8 is then threaded into the top portion 3. The installation of the marker post 10 is now complete.

The benefits of the marker post 10 become obvious when someone or something comes into contact with it and pushes it over. When the marker post pipe 7 is pushed the spring 6 flexes. Upon release or removal of the object pushing the pipe 7 the spring 6 returns the pipe 7 to its upright position. The marker post pipe 7 will flex regardless of the direction from which it is hit and will return to its upright position.

Figure 4:
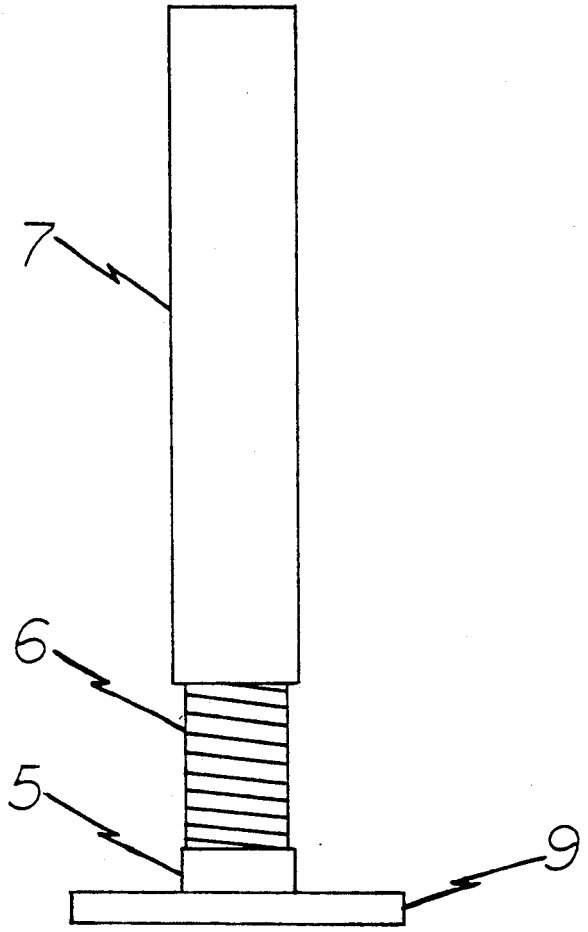
FIG. 4 illustrates another embodiment of the invention.

Referring to FIG. 4, another embodiment of the invention consists of a flat base 9 instead of the spike base of FIG. 1 for securing the upper section of the marker post 8. The base 9 could be made of metal, cement or any type of material as long as some method of fastening the upper section of the marker post to it were possible. This type of base would allow the marker post to be placed on a hard surface or allow the marker post to be moved from place to place.

Another embodiment of the invention consists of a button fastening and release system instead of threads to fasten the upper section of the marker post to its base. This system operates by pushing a small button in the area of the stud, on the marker post, which would disengage the upper section of the marker post from the base. To reassemble the upper section of the marker post to its base would require pushing the upper section of the marker post into its base. Once in the base the upper section of the marker post would simply have to be turned manually until the button engaged in the opening in the base.

In all embodiments of the invention the marker post pipe can be made in various lengths, sizes and shapes assuming the base and spring can tolerate its needs. The spring must be of sufficient size and strength to restore the marker post pipe to its original upright position after impact. The base must be able to hold the spring and marker post pipe under substantial stresses.

In still another embodiment, the marker pipe could be covered by a soft foam or rubber to protect the impacting object. Also, a reflecting material could be secured to the outer surface of the foam or rubber for night time visibility.

Although the invention is described with respect to a preferred embodiment, modification thereto will be apparent to those skilled in the art. Therefore the scope of the invention is to be determined by reference to the claims which follow.

I claim:

1. A marker post for identifying a location comprising:

a base having a bottom portion fixed to a surface and an upper portion having a means for connection;

flexing means having a first internal diameter and a first external diameter, said flexing means further having a bottom end axially coupled to said means for connection and responsive to an external force for deflecting a predetermined amount;

a pipe axially coupled to a top end of said flexing means for receiving said external force, said pipe having a second internal diameter smaller than said first external diameter, said pipe being axially forced over said upper end of said flexing means.

2. The marker post of claim 1 wherein said bottom portion of said base is tapered for insertion into the ground.

3. The marker post of claim 2 wherein said means for connection includes a first threaded portion axially positioned in said upper portion of said base.

4. The marker post of claim 3 wherein said flexing means comprises:

a spring having said first internal diameter and said first external diameter;

a stud having a second external diameter greater than said first internal diameter, said stud being axially forced into said lower end of said spring for fixing said stud to said spring;

said stud further having a second threaded portion for axially interlocking said bottom end with said first threaded portion.

5. The marker post of claim 4 wherein said flexing means allows said marker post to be impacted in its upright position without damage to said marker post and an impacting object.

6. The marker post as set forth in claim 3 wherein said means for connection is substantially easy to operate to allow for removal and reinstallation of said pipe including said flexing means from said base without substantial effort.

7. The marker post of claim 1 wherein said bottom portion has a substantially flat and wide bottom for resting on a horizontal surface thereby maintaining said marker post in a vertical position.

8. A marker post comprising:

a detachable base means having a taper at a lower end for installation in the ground, and a thread means at an upper end;

a stud means having a mating thread at one end being fastened to said thread means for securing said stud means to said upper end of said base, said stud means having a first external diameter at an opposite end;

a spring means having a first internal diameter and a second external diameter, wherein said first internal diameter is smaller than said first external diameter of said stud means, and wherein a first end of said spring means is axially forced over said first external diameter of said stud means;

a pipe means having a second internal diameter smaller than said first external diameter of said spring means, wherein a second end of said spring means is axially forced into said second internal diameter of said pipe means thereby enabling said pipe means to flex relative to said base means.

9. The marker post of claim 8 which is detachable for its base means so that said base means remains in the ground.

10. The marker post of claim 9 wherein said base is of sufficient size to hold said spring means and said pipe means in the upright position and when impacted.

11. The marker post of claim 10 wherein said spring means is of substantially sufficient size and strength to allow said pipe means to be impacted in the upright position, bend and be returned to its previous upright position.

* * * * *